US005743527A

United States Patent [19]

Harley

[11] Patent Number: 5,743,527

[45] Date of Patent: Apr. 28, 1998

[54] PLAYING CARD HOLDER

[76] Inventor: Peter John Harley, 2 Liverpool Street, North Fitzroy, Victoria, Australia, 3068

[21] Appl. No.: 696,853

[22] PCT Filed: Feb. 7, 1995

[86] PCT No.: PCT/AU95/00060

§ 371 Date: Aug. 7, 1996

§ 102(e) Date: Aug. 7, 1996

[87] PCT Pub. No.: WO95/21007

PCT Pub. Date: Aug. 10, 1995

[30] Foreign Application Priority Data

Feb. 7, 1994 [AU] Australia ..... PM 3706

[51] Int. Cl.[6] ..... A63F 1/10

[52] U.S. Cl. ..... 273/150; 273/148 R

[58] Field of Search ..... 273/148 A, 150

[56] References Cited

U.S. PATENT DOCUMENTS

| | | | |
|---|---|---|---|
| D. 367,082 | 2/1996 | Harley | D21/54 |
| 2,520,490 | 8/1950 | Boward . | |
| 2,628,051 | 2/1953 | Anderson | 273/150 |
| 2,694,576 | 11/1954 | Ivey . | |
| 3,620,535 | 11/1971 | Cerney et al. . | |
| 4,266,771 | 5/1981 | Carbone et al. | 273/150 |
| 4,625,966 | 12/1986 | Sweet . | |
| 4,630,824 | 12/1986 | Sweet | 273/150 |
| 5,029,797 | 7/1991 | Levorchick et al. | 273/150 |

FOREIGN PATENT DOCUMENTS

| | | | |
|---|---|---|---|
| 26924/88 | 6/1989 | Australia . | |
| 4108919 | 9/1991 | Germany | 273/150 |
| 496778 | 8/1954 | Italy | 273/150 |

*Primary Examiner*—Raleigh W. Chiu
*Attorney, Agent, or Firm*—Richard M. Goldberg

[57] ABSTRACT

A playing card holder which includes a generally upstanding slot device extending into wings, the slot device being formed from a front plate and a rear plate with an elongated depression therebetween, the slot device being supported by a pillar which is capable of being supported by grasping the pillar by the fingers or one hand or supporting the pillar directly on a horizontal surface.

10 Claims, 1 Drawing Sheet

PLAYING CARD HOLDER

FIELD OF THE INVENTION

This invention relates to an aid for holding and viewing playing cards.

BACKGROUND OF THE INVENTION

There is a need for a device which will hold playing cards, for example, for use by children or others with small hands, by elderly people where strength and motor control is lacking and by disabled persons such as persons without one or both hands.

U.S. Pat. No. 2,520,490 Boward discloses a playing card holder. This device comprises a horizontal platform in association with an upright shield to guard the cards from observation. A grooved card holding strip is located on the horizontal platform.

U.S. Pat. No. 4,625,966 Sweet discloses a playing card holder which essentially comprises two plates which, when placed together, diverge within an angular range of about 1°–8°. Such divergence produces a tapered slot within which the playing cards are inserted. In other words the cards are held by a wedging action.

AU-A-26924/88 Krotofil also discloses a playing card holder which has an arcuate slot formed in at least one piece of resilient material. An essential feature of this device is the use of a relatively massive base included in this at least one piece of resilient material.

There is a need for a simple playing card holder which may be either held in the hand with comfort or placed on a horizontal surface such as a table.

BRIEF SUMMARY OF THE INVENTION

This invention provides a playing card holder which comprises:

1) a generally upstanding slot means extending into wings, the slot means being formed from a front plate means and a rear plate means with an elongated depression therebetween; the slot means being supported by
2) a pillar which is capable of being supported by a process selected from the group consisting of grasping the pillar by the fingers of one hand and supporting the pillar directly on a horizontal surface.

BRIEF DESCRIPTION OF THE DRAWINGS

One embodiment of the playing card holder according to the invention is illustrated in the accompanying drawings in which.

DETAILED DESCRIPTION OF THE INVENTION

Figure 1:
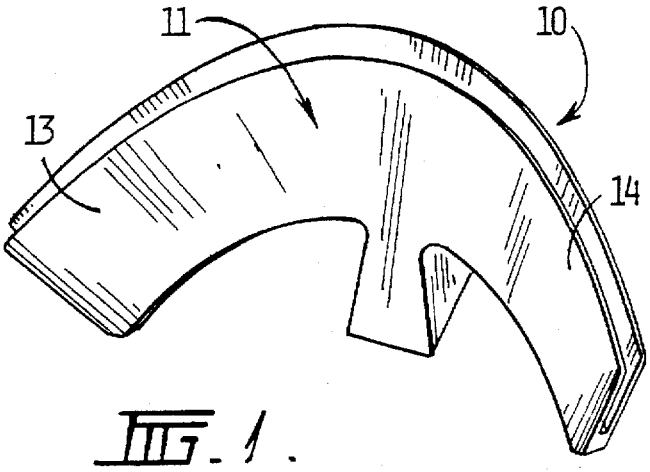
FIG. 1 is a view from the front and one side of the holder.
Figure 3:
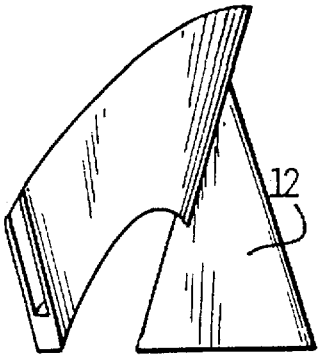
FIG. 3 is a view from the left side of the holder.
Figure 2:
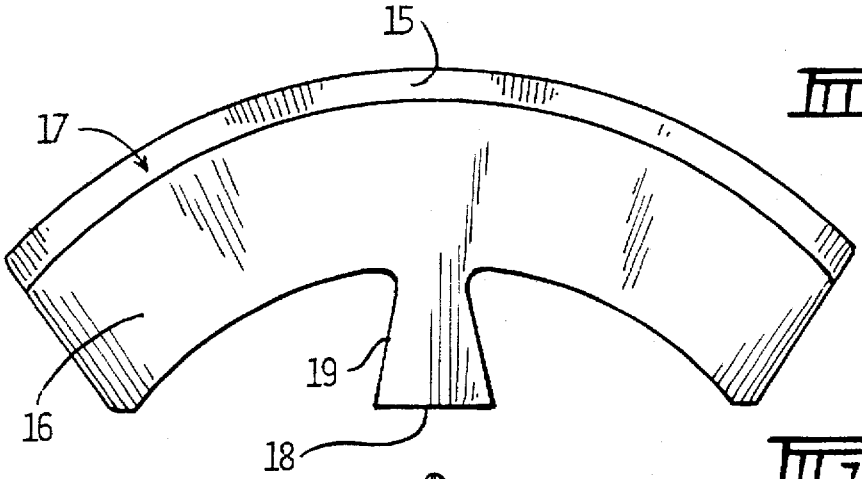
FIG. 2 is a view from the front and centre of the holder.
Figure 4:
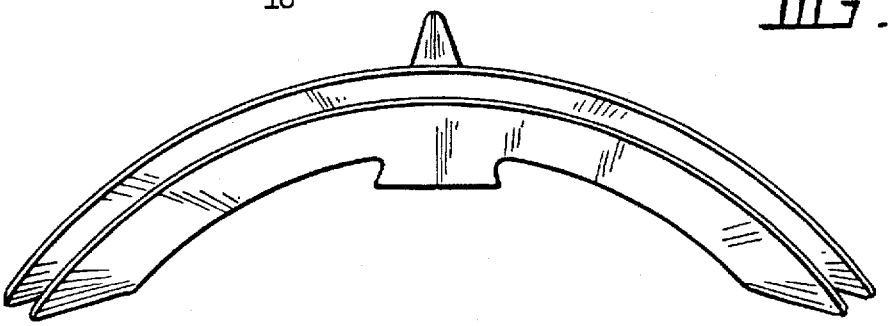
FIG. 4 is a plan view from the top of the holder.
Figure 5:
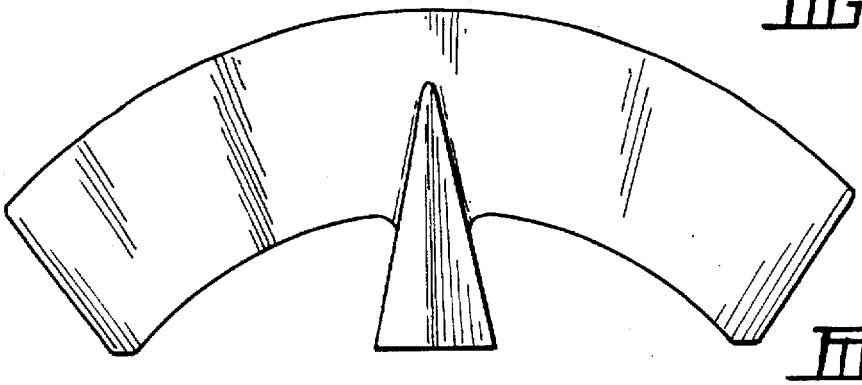
FIG. 5 is a view from the rear of the holder.

The slot means is preferably curved, for example, so that the rear plate means forms a portion of the surface of a cylinder in which the radius of the cylinder is from 100 mm to 180 mm and the front plate is correspondingly so formed.

Alternatively the rear plate means forms a portion of the surface of a cone in which the radius at the top of the plate means is generally greater than the radius at the bottom of the plate means, each radius being from 100 mm to 180 mm and the front plate means is correspondingly so formed.

The elongated depression between the rear plate means and the front plate means is preferably substantially parallel-sided.

The elongated depression is so dimensioned that a card may be grasped lightly at three points (or regions).

The elongated depression is conveniently of uniform depth along its length.

The depth of the elongated slot is such that a playing card when fully inserted in the slot remains partially exposed to view.

Preferably the elongated depression is wider at the bottom than at the top.

Conveniently the top edge or edges of the elongated depression are bevelled to allow easy insertion of cards.

The elongated depression may be lined with a velvet-like fabric or other suitable coating so that cards when inserted are further restrained against movement by their contact with the soft lining of the elongated depression.

It is preferred that the top and bottom of both plate means be curved in a second direction so that the central region of each plate means which is located over the pillar is higher than the respective wings to deter opposing card players from seeing cards positioned at the wings and to allow the central pillar to be grasped by the hand of the card player.

The pillar preferably has a bottom adapted to enable the holder to sit on a flat surface.

It is preferred that at least the bottom ends of each wing of the slot means and the bottom of the pillar be in a plane such that the holder may rest on these three points (or regions) with the slot means extending upwards.

Preferably the points (or regions) form a triangle with an apex substantially at the rearmost extremity of the pillar.

The apex of the triangle may be moved outwards to increase stability of the holder.

The words "rearmost" and "outwards" refer to a direction externally and away from the curved slot means.

The device may be made of any suitable material such as laminated cardboard, wood or moulded plastic and may be covered with a suitable fabric or coating, Turning to the drawings, numeral 10 refers to the playing card holder as a whole. The holder comprises a slot means 11 supported by a pillar 12. The slot means 11 comprises two wings 13 and 14.

Slot means 11 is formed from rear plate means 15 and front plate means 16 which between them form elongated, parallel-sided depression 17 (when one considers vertical element of the depression).

Pillar 12 ends in lower flat bottom 18. Just above flat bottom 18 is a finger-grasping portion 19.

What is claimed:

1. A playing card holder comprising:

(a) a generally upstanding slotted body extending into wings, each of the wings having a bottom end defining a resting point for resting on a flat support surface, the slotted body being formed from a front plate and a rear plate with a substantially parallel sided elongated depression therebetween for receiving playing cards therein, the elongated depression being so curved and dimensioned that a playing card received in the depression is curved so that it is grasped lightly at three points, two of said three points being at the rear plate and the remaining one point of said three points being at the front plate, whereby the playing card is lightly restrained against movement; and (b) a pillar which supports the slotted body, the pillar having a bottom to contact and rest on the flat support surface, the bottom ends of the wings and the bottom of the pillar being in a same plane, whereby the slotted body is supported at the election of a user by one of:
i) grasping the pillar by the fingers of one hand, and
ii) resting the bottom ends of the wings and the bottom of the pillar directly on the flat support surface.

2. A holder as claimed in claim 1, wherein the slotted body is curved in plan view.

3. A holder as claimed in claim 2, wherein the rear plate forms a portion of the surface of a cylinder in which the radius of the cylinder is from 100 mm to 180 mm and the front plate is correspondingly so formed.

4. A holder as claimed in claim 2, wherein the rear plate forms a portion of the surface of a cone in which the radius at the top of the rear plate is greater than the radius at the bottom of the rear plate, each radius being from 100 mm to 180 mm and the front plate is correspondingly so formed.

5. A holder as claimed in claim 1, wherein both the rear plate and the front plate have central portions which are raised in a front elevational view of the holder so that the center portion of each of the rear plate and front plate is higher than its respective wing the pillar being located substantially at said center portion of each of the rear plate and front plate to provide space for the user's fingers to grasp the pillar.

6. A holder as claimed in claim 1, wherein the bottom of the pillar has a point which rests on the flat support surface and which defines together with the resting points of the wings a triangle with an apex substantially at a rearmost extremity of the pillar.

7. A playing card holder which comprises a generally upstanding slotted body extending into wings, each of the wings having a lower extremity defining a resting point for resting on a flat horizontal support surface, the slotted body being formed from a front plate and a rear plate with a substantially parallel sided elongated depression therebetween for receiving playing cards therein, the slotted body being supported by a centrally located pillar extending down from the bottom of the slotted body, the pillar having a bottom to contact and rest on the flat horizontal support surface, the lower extremities of each of the wings and the bottom of the pillar being in a same plane, whereby the slotted body is supported at the election of a user by one of (a) grasping the pillar by the fingers of one hand and (b) resting the lower extremities of the wings and the bottom of the pillar directly on the horizontal flat support surface, the slotted body having a central portion which is raised in a front elevational view of the holder so that the bottom of the slotted body at its central portion above the pillar is higher than the lower extremities of the respective wings, thereby providing space for the user's fingers to grasp the pillar, the lower extremities of the wings lying in a plane with the bottom of the pillar, thereby enabling the holder to rest on three resting points including one resting point at the lower extremity of each wing and a resting point at the bottom of the pillar.

8. A holder as claimed in claim 7 wherein the bottom of the pillar rests on the flat horizontal support surface at its resting point which is at least close to a point on the bottom which is most distant from a line drawn between the resting points of contact of the lower extremities of the wings so that the three resting points from a stable triangular base.

9. A holder as claimed in claim 7 wherein the pillar broadens in a downwards direction from the bottom of the slotted body to the bottom of the pillar.

10. A holder as claimed in claim 7 wherein the slotted body is curved in a front elevational view of the holder to thereby elevate the bottom of the slotted body at its central portion above the pillar higher than the lower extremities of the respective wings and thereby provide the space for the user's fingers to grasp the pillar.

* * * * *